US010788273B2

(12) United States Patent
Rizzi

(10) Patent No.: US 10,788,273 B2
(45) Date of Patent: Sep. 29, 2020

(54) SHELL-AND-TUBE EQUIPMENT WITH ANTIVIBRATION BAFFLES AND RELATED ASSEMBLING METHOD

(71) Applicant: Casale SA, Lugano (CH)

(72) Inventor: Enrico Rizzi, Casnate con Bernate (IT)

(73) Assignee: Casale SA, Lugano (CH)

( * ) Notice: Subject to any disclaimer, the term of this patent is extended or adjusted under 35 U.S.C. 154(b) by 0 days.

(21) Appl. No.: 15/741,696

(22) PCT Filed: Jun. 3, 2016

(86) PCT No.: PCT/EP2016/062607
§ 371 (c)(1),
(2) Date: Jan. 3, 2018

(87) PCT Pub. No.: WO2017/005429
PCT Pub. Date: Jan. 12, 2017

(65) Prior Publication Data

US 2018/0224219 A1 Aug. 9, 2018

(30) Foreign Application Priority Data

Jul. 6, 2015 (EP) ..... 15175397

(51) Int. Cl.
*F28F 9/013* (2006.01)
*F28D 7/16* (2006.01)
(Continued)

(52) U.S. Cl.
CPC ..... *F28F 9/0131* (2013.01); *F28D 7/16* (2013.01); *F28F 1/30* (2013.01); *F28F 9/013* (2013.01);
(Continued)

(58) Field of Classification Search
CPC ..... F28F 2225/04; F28F 2240/00; F28F 2009/226; F28F 9/013; F28F 9/0131;
(Continued)

(56) References Cited

U.S. PATENT DOCUMENTS 2,229,344 A * 1/1941 Schneider ..... F22D 1/006 165/162
2,433,731 A * 12/1947 Brinen ..... B21D 53/06 29/890.043

(Continued)

FOREIGN PATENT DOCUMENTS

CN 101598510 A 12/2009
FR 2993217 A1 1/2014
WO 2014/207013 A1 12/2014

OTHER PUBLICATIONS

International Search Report dated Sep. 23, 2016 in connection with PCT/EP2016/062607.

(Continued)

*Primary Examiner* — Jianying C Atkisson
*Assistant Examiner* — Jose O Class-Quinones
(74) *Attorney, Agent, or Firm* — Akerman LLP

(57) ABSTRACT

Shell-and-tube equipment includes baffles supporting the tubes, each baffle having seats for receiving the tubes shaped so as to receive one or more tubes in at least one free play condition and in a locking condition; each baffle is displaceable with respect to the tube bundle between an assembly position and a working position; in the assembly position the tubes can be received by the baffles in the free play condition while in the working position the tubes are locked.

13 Claims, 6 Drawing Sheets

(51) Int. Cl.
*F28F 1/30* (2006.01)
*F28F 9/22* (2006.01)

(52) U.S. Cl.
CPC ..... *F28F 2009/226* (2013.01); *F28F 2265/30* (2013.01); *F28F 2280/02* (2013.01); *F28F 2280/10* (2013.01)

(58) Field of Classification Search
CPC .. F28F 9/0135; F28F 2265/30; F28F 2265/32; F28F 9/0133; F28F 2009/222; F28D 1/0475; F28D 1/053; F28D 7/16; F28D 7/1615; B26K 2101/14; B23P 2700/10; B21D 53/06; B21D 53/08; B21D 15/26; Y10T 29/49373
USPC ..... 29/890.03, 890.031, 890.04, 890.043, 29/890.047; 165/159, 161, 162, 165/DIG. 346, DIG. 352, DIG. 401
See application file for complete search history.

(56) References Cited

U.S. PATENT DOCUMENTS 3,176,762 A * 4/1965 Greenwood ..... F28F 9/0135 165/162
3,420,297 A 1/1969 Romanos
3,616,848 A * 11/1971 Kaelin ..... F28D 7/024 165/67
3,782,455 A * 1/1974 Wolowodiuk ..... F22B 1/162 165/162
4,058,161 A * 11/1977 Trepaud ..... F22B 1/026 165/158
4,143,709 A 3/1979 Cunningham
4,154,295 A * 5/1979 Kissinger ..... F28F 9/0133 165/162
4,204,305 A * 5/1980 Norton ..... B23P 15/26 29/890.043
4,492,851 A * 1/1985 Carr ..... F25D 21/08 165/181
5,058,664 A 10/1991 Gentry
5,178,822 A * 1/1993 Buford, III ..... C23G 1/00 122/379
5,642,778 A 7/1997 Gentry
5,653,282 A * 8/1997 Hackemesser ..... F22B 1/1869 165/134.1
5,915,472 A * 6/1999 Takikawa ..... F28D 7/1607 165/158
6,059,022 A * 5/2000 Wilson ..... F28F 9/0131 165/159
7,269,966 B2 * 9/2007 Lowenstein ..... F24F 3/1417 261/156
2003/0173066 A1 9/2003 Mulder
2006/0231243 A1 * 10/2006 Sugihara ..... F28D 7/0066 165/158
2007/0181292 A1 * 8/2007 Jekerle ..... F28D 7/06 165/159
2009/0200004 A1 * 8/2009 Johnston ..... F28D 7/16 165/172
2009/0301699 A1 12/2009 Karrs et al.
2012/0193074 A1 * 8/2012 Panumma ..... F28D 7/0066 165/104.11
2013/0255923 A1 10/2013 Artamo et al.
2018/0306526 A1 10/2018 Rizzi

OTHER PUBLICATIONS

International Preliminary Report on Patentability dated Oct. 31, 2017, in connection with PCT/EP2016/062607.
Written Opinion of the International Searching Authority dated Sep. 29, 2016, in connection with PCT/EP2016/062607.
Response to Written Opinion filed on Jun. 1, 2017, in connection with PCT/EP2016/062607.

* cited by examiner

SHELL-AND-TUBE EQUIPMENT WITH ANTIVIBRATION BAFFLES AND RELATED ASSEMBLING METHOD

This application is a national phase of PCT/EP2016/062607, filed Jun. 3, 2016, and claims priority to EP 15175397.7, filed Jul. 6, 2015, the entire contents of both of which are hereby incorporated by reference.

FIELD OF APPLICATION

The invention relates to the field of shell-and-tube equipment.

PRIOR ART

In shell-and-tube equipment it is known to provide a certain number of baffles which have essentially two tasks: the first is that of increasing the speed of the fluid flowing in the shell side and passing over the tubes, thus increasing the heat exchange coefficient; the second is that of providing the tubes with intermediate support points along the bundle so as to prevent vibrations. The need to prevent vibrations is more felt when speed of the fluid circulating inside the shell is higher.

Each baffle has openings intended to receive a single tube or a set of tubes, and may be realized for example with a series of bars fixed to an external frame or with a sheet-metal disc suitably perforated. The baffles are spaced by a given distance, called pitch; it is also known to alternate baffles having a different geometry so that adjacent baffles provide a support to different groups of tubes and/or in perpendicular directions. Another requirement for the baffles is to allow a suitable through-flow of fluid, generally a gas, through the shell side.

Shell-and-tube equipment provided with the aforementioned baffles is described for example in the prior art patents U.S. Pat. Nos. 5,058,664, 5,642,778 and FR 2 993 217.

The known construction technique involves essentially the following steps: providing a framework comprising the baffles and respective longitudinal bars; inserting the tubes by passing them through the various baffles; fixing the tubes to the tube plates. This technique, however, is problematic and has a number of drawbacks. Each tube has to match the corresponding through-holes in the baffles which have a fairly small tolerance (otherwise the baffles would not be effective in preventing vibrations); the operation is feasible for the first tubes when the set of baffles and longitudinal bars still has a certain mobility; however, as the tubes are gradually inserted, the assembly becomes more rigid and positioning of the tubes becomes more difficult; insertion of the last tubes is typically performed by forcing them with a hammer and this practice can damage the tubes themselves. For example it has been noticed that, with this assembly technique, the surfaces of the tubes are damaged owing to the friction with the baffles. The baffles are also damaged, with the risk of breakage during operation. Breakage during operation is dangerous since tubes would lack support and be exposed to vibrations. Moreover, assembly performed in the above way requires a lot of time and is therefore costly.

The prior art seeks a compromise between a precise fit between tubes and baffles, which is more effective in reducing the vibrations but greatly complicates the assembly, and a less precise fit, which makes the assembly easier, but reduces the effectiveness against vibrations.

SUMMARY OF THE INVENTION

The object of the invention is to solve the aforementioned problems and facilitate the construction of shell-and-tube equipment provided with antivibration baffles.

This object is achieved with shell-and-tube equipment according to the attached claims.

The equipment comprises a shell; a tube bundle; a plurality of baffles arranged along the tube bundle, each baffle having a plurality of receiving seats for said tubes and each of said seats receiving at least one tube of the bundle, and is characterized in that:

said seats of the baffles are shaped so as to comprise at least a first region designed to receive said at least one tube with a given first play, and a second region designed to receive said at least one tube with a second play which is smaller than the first play, or with substantially no play, each baffle is displaceable, with respect to the tube bundle, between a first position, termed assembly position, and a second position, termed working position, each tube of the bundle is received in the first region of the respective seat when the baffle is in the assembly position, and is received in the second region when the baffle is in the working position.

The invention provides that the baffles can be set in an assembly configuration and in a working configuration. The tubes receiving seats of a generic baffle are shaped and oriented so that the displacement of the baffle from the assembly position to the working position gives a substantial locking of the tubes relative to the baffle. The displacement of a baffle from the assembly position to the working position is such that the respective seats move collectively from the assembly position to the working position.

In greater detail, in the assembly position a play allowing free sliding movement exists between the tubes and the respective seats of the baffles. In the working position this play is reduced or preferably null and, consequently, the tubes are locked or substantially locked with respect to the baffles.

The tubes receiving seats are oriented so that the locking of the tubes (i.e. the transition from the assembly position to the working position) is performed with a displacement or a rotation. Accordingly, the tube locking system may be named "shift-lock" when it occurs with a linear displacement of the baffles, and "twist-lock" when it occurs with a rotation. During locking, the tube receiving seats move along a linear path in the shift-lock embodiments or follow a circular arc in the twist-lock embodiments.

For example, in a preferred embodiment of the baffles with shift-lock system, the receiving seats are oriented so as to obtain locking of the tubes with a displacement of the baffles in a plane perpendicular to the axis of the tube bundle; in a preferred embodiment of the twist-lock type the seats are oriented so as to lock the tubes with a rotation of the baffles relative to said axis.

According to one aspect of the invention, two or more series of baffles with different locking movements are alternated. In particular, according to a preferred embodiment, at least two series of baffles configured to lock the tubes with opposite movements are provided. Said term of "opposite movements" refers respectively to translations along the same axis having opposite direction (shift-lock), or rotations about the same axis having opposite sense (twist-lock).

Preferably, the receiving seats comprise at least one effective surface which, in the assembly position, is spaced from a respective tube and, in the working position, comes into contact with said tube obtaining the desired locking effect. Said effective surface is advantageously inclined with respect to the locking direction. The term "locking direction" is understood as meaning the direction of movement of said surface towards the respective tube. Said locking direction is for example the direction of displacement of the baffles in the shift-lock embodiments and is the tangent to the arc travelled by the receiving seat in the twist-lock embodiments.

More advantageously, each tube receiving seat comprises two effective surfaces which converge forming a wedge-like zone where the tube is locked. For example a seat in accordance with this embodiment may have a trapezoidal shape.

The seats may be designed to receive a single tube or several tubes each, depending on different embodiments of the invention.

In some embodiments each baffle is a flat plate (for example a sheet-metal disc) and the seats are windows formed in the baffle using a suitable method, for example by laser cutting or water cutting, or by punching which is a particularly low-cost technique.

In the twist-lock embodiments, tubes receiving seats having a different shape depending on their distance from the axis of rotation may be provided. Said measure provides a uniform tube locking effect, compensating for the fact that arcs travelled by the seats closer to the axis of rotation are shorter than that of the seats away from the axis. For example, the above mentioned effective surfaces may have a greater inclination (greater locking angle) close to the axis.

The twist-lock embodiments allow the tubes to be arranged on concentric circles instead of being arranged in a square or triangular pitch. According to a particular embodiment of the invention, the tubes are arranged in concentric rows and the baffles comprise a plurality of concentric rings in which each ring comprises the tube receiving seats. For example, the seats intended to receive the tubes may be realized substantially as recesses formed in the edges of said rings.

Another aspect of the invention relates to a method for assembling shell-and-tube equipment comprising antivibration support baffles for the tubes, according to the accompanying claims. Said method for example comprises the steps of:

providing baffles in a provisional assembly configuration where the tubes of the bundle can be inserted being received with play in the first region of the respective seats of the baffles;

inserting the tubes until the tube bundle is completed;

displacing the baffles into a working configuration where the tubes are received in the second region of the seats of each baffle, with a small or substantially null play (locked tubes).

In the assembly configuration the baffles are preferably kept in position with a template or equivalent provisional means. For example in the assembly configuration the baffles are already spaced by the working pitch, but they are offset so that each tube encounters the receiving seats in the respective first region, that is with play. Optionally, the baffles may have a certain axial mobility in the assembly configuration.

Preferably, the definitive locking of the baffles in the working configuration is performed by the shell itself of the equipment, by means of a direct structural cooperation between the baffles and the shell. In accordance with this further preferred aspect of the invention, after displacement of the baffles into the respective working positions, the assembly of the tube bundle and the baffles is assembled together with the shell of the equipment and the baffles are locked in the respective working positions directly by said shell.

It should be noted that the shell does not have any play with respect to the baffles. Assembly is for example performed by assembling two or more halves of the shell or by constructing the shell using a fairly thin metal sheet which can be wrapped around the tube bundle. In other embodiments, locking of the baffles may be performed using a conventional technique, for example using tie bars; in this case the bundle does not cooperate structurally with the shell and may be simply inserted into the shell.

The invention is applicable to equipment with straight tubes and equipment with U-shaped tubes. In the latter, the baffles are mounted along the straight sections of the U-shaped tubes.

The great advantage of the invention consists in a simplified assembly without adversely affecting the effectiveness against vibrations. The tubes may be positioned without difficulty since assembly is performed with play relative to the baffles; in operation, however, said play is substantially removed and the tubes finds a precise support on the baffles. These and other advantages of the invention will emerge more clearly with the aid of the detailed description below relating to a number of preferred embodiments.

DETAILED DESCRIPTION

Figure 1:
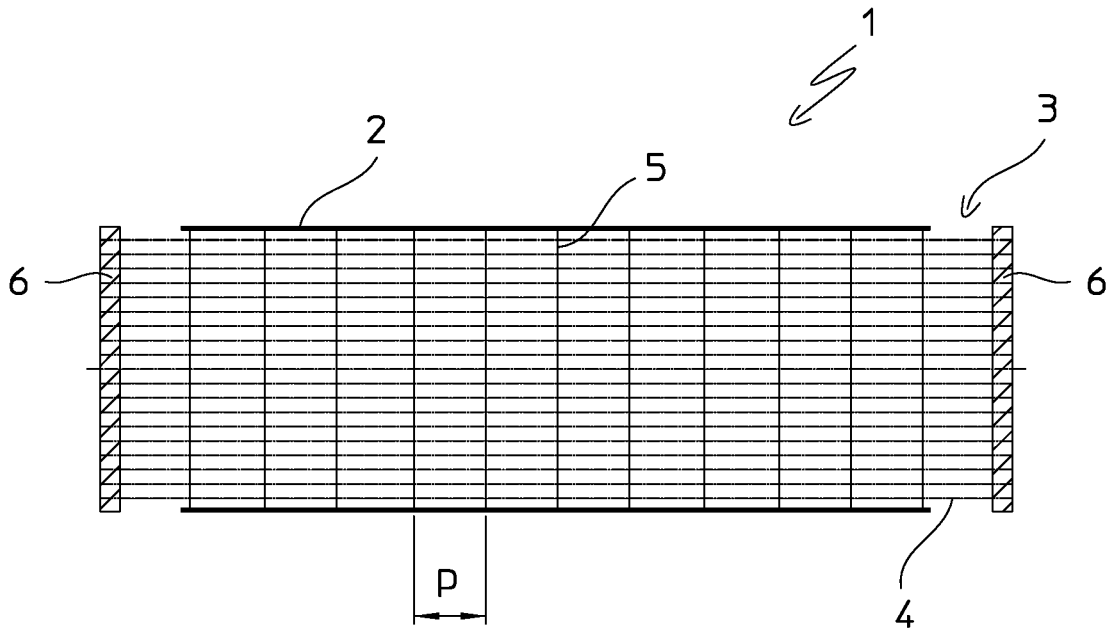
FIG. 1 shows a simplified diagram of shell-and-tube equipment comprising a series of antivibration baffles.

FIG. 1 shows in schematic form a shell-and-tube equipment 1 comprising a shell 2; a bundle 3 of straight tubes 4; a plurality of baffles 5 spaced by a pitch p and acting as antivibration supports for the tubes 4; two tube plates 6. FIG. 1 shows only the axes of the tubes for the sake of simplicity.

Figure 2:
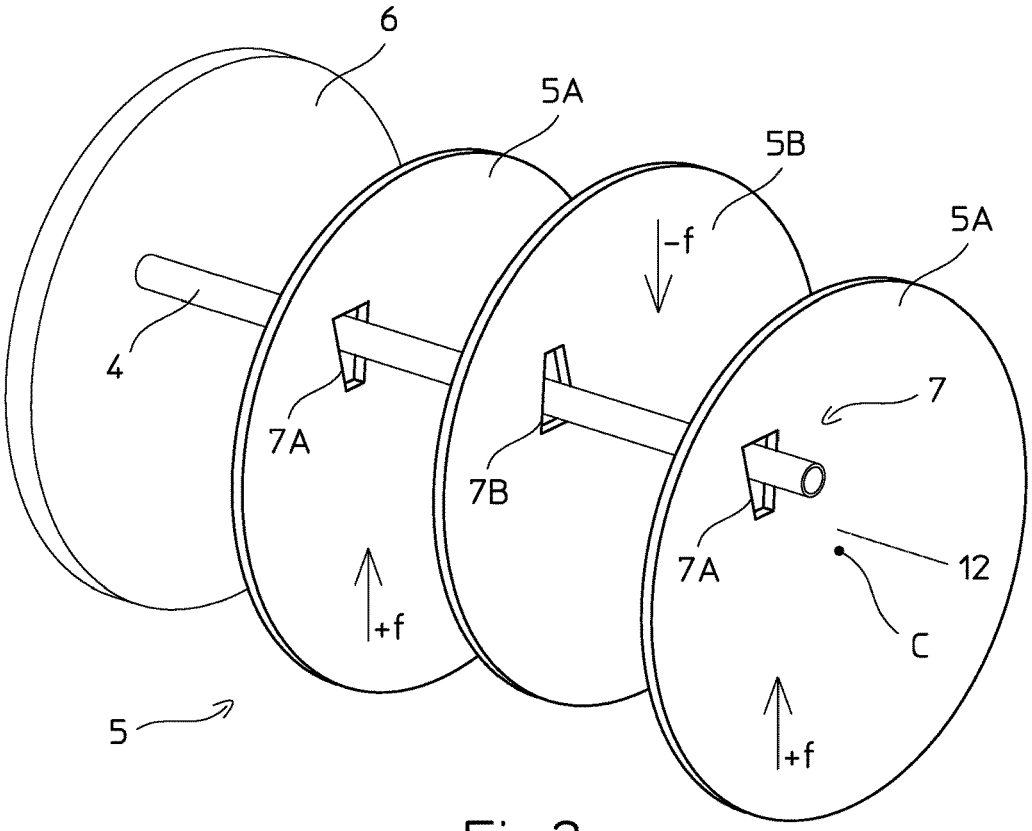
FIG. 2 shows in schematic form a series of baffles of the equipment shown in FIG. 1, according to a first embodiment of the invention.

FIG. 2 relates to a first embodiment of the invention and, for the sake of simplicity, shows a single tube 4 passing through the baffles 5. Each baffle 5 comprises a series of passing-through openings in the form of windows 7 which allow the passage of tubes. The reference number 5 denotes collectively the set of baffles and the reference number 7 denotes collectively the windows formed in the baffles. In the example according to FIG. 2 the windows 7 have a trapezoidal form, more preferably the form of an isosceles trapezium.

Figure 3:
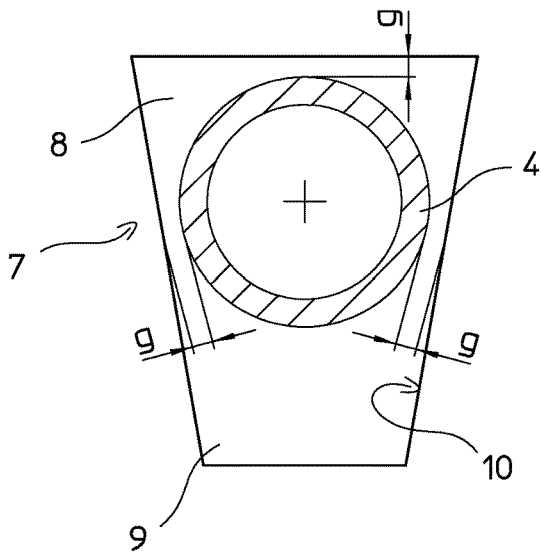
FIGS. 3 and 4 show locking of a tube in a respective window of one of the baffles, according to the embodiment of FIG. 2.
Figure 4:
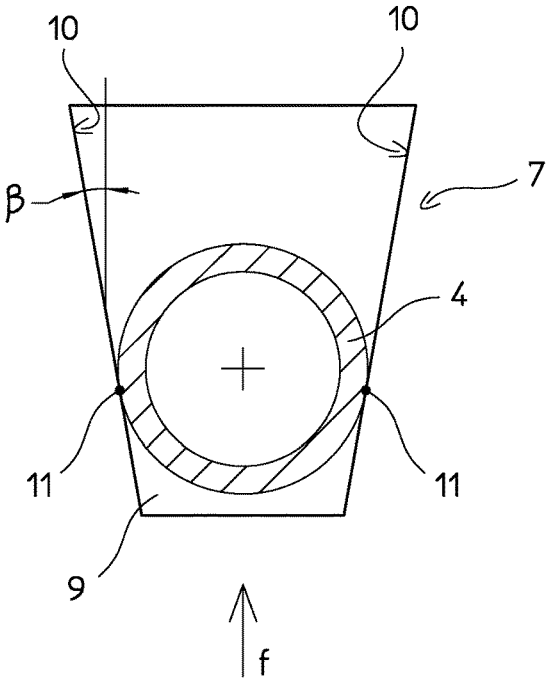

As shown in FIGS. 3 and 4, a trapezoidal window 7 comprises a region 8 in the proximity of the long base which may receive a tube 4 with a certain play g and a second region 9 close to the short base of the trapezium in which, instead, a tube 4 is received substantially with no play (i.e. locked), bearing against internal surfaces 10 defined by the two converging sides of the window 7 (FIG. 4.).

The play g allows the tube 4 to freely slide through the window 7. A slight misalignment between tube and window is in fact compensated for by the play g during the assembly. In the region 9 instead the converging sides of the trapezoidal window 7 form a wedge-like zone which eliminates the play g and lock the tube 4 which finds two points of contact 11 with said surfaces 10. Therefore, it can be noted that the arrangement shown in FIG. 3 allows easier assembly while the arrangement shown in FIG. 4, during operation, ensures an effective action against the vibrations thanks to the bearing contact of the tube against the surfaces 10.

Locking of the tube 4 inside the window 7 (i.e. the passage of the tube from the receiving region 8 with play to the substantially locked region 9) is the result of a linear displacement f of the window 7 with respect to said tube.

It should be noted that the locking is the result of a suitable inclination β of the surfaces 10 relative to the locking direction (FIG. 4). Here, said surfaces 10 are termed "effective surfaces" since they provide the tube with the desired antivibration support. The locking direction may be defined as being the direction in which the tube moves towards the region 9 (and therefore towards the surfaces 10) which, in this example, is the direction of the displacement f. For short, said angle β is also called locking angle.

In the example, for each tube 4 there are two surfaces 10 which converge defining a wedge-like locking zone. More generally it is preferable to provide at least one surface inclined with respect to a locking direction of the tubes.

With reference still to FIG. 2, it is shown a preferred embodiment in which the set of baffles 5 comprises a first series of baffles 5A with a first orientation of the windows 7, and a second series of baffles 5B with windows 7B having a second orientation. As a result of the different orientation, the baffles of the two series denoted by A and B respectively have different locking directions, for example the baffles 5A are locked with a displacement +f and the baffles 5B are locked with an equal and opposite displacement −f.

It should be noted that the locking operation brings the baffles back into axial alignment with the tube bundle, i.e. eliminates the misalignment shown in FIG. 2. FIG. 2 shows the centre of a baffle and the axis 12 of the equipment. The figure thus highlights the misalignment of the baffles during the assembly, which is eliminated by the displacement +f or −f.

Figure 5:
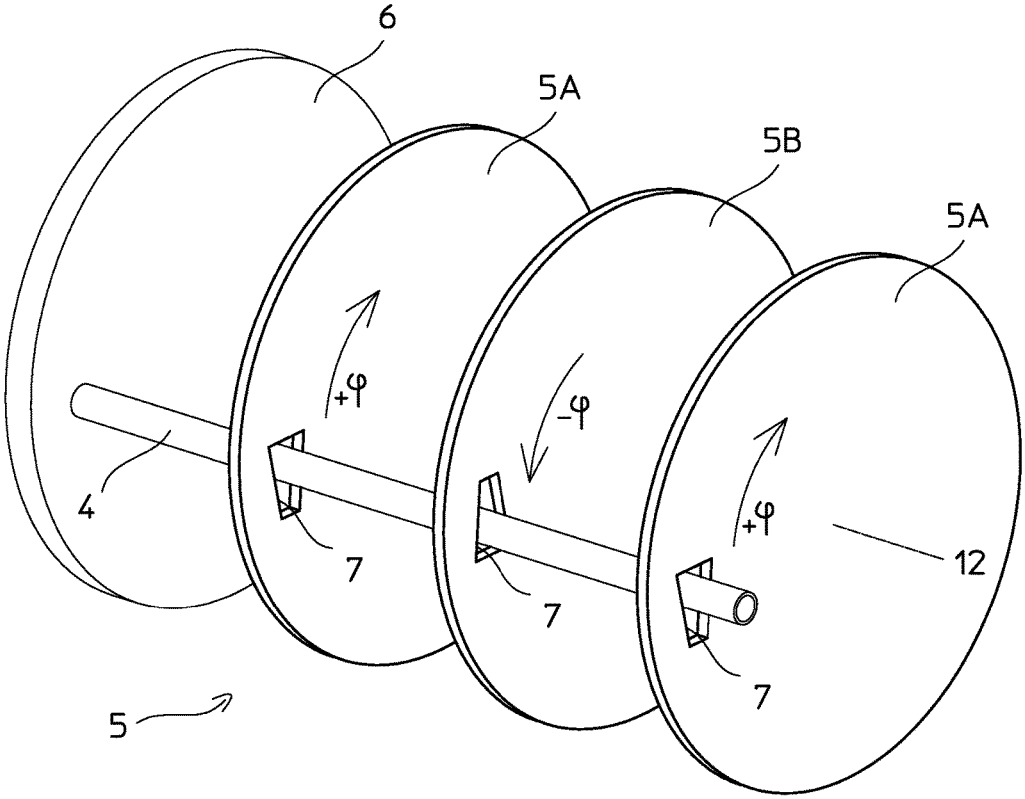
FIGS. 5 to 7 are similar to FIGS. 2 to 4 and show another embodiment of the invention.
Figure 6:
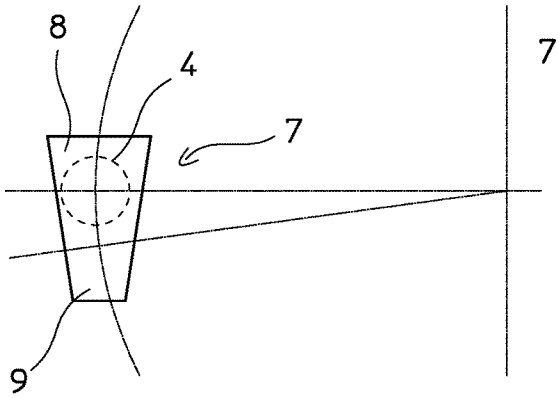
Figure 7:
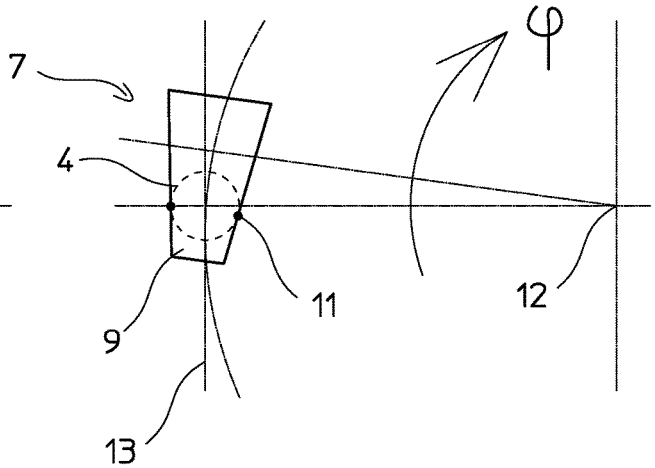

FIGS. 5 to 7 are similar to FIGS. 2 to 4, and show an embodiment where the locking of the tubes is obtained with a rotation about the axis 12 of the equipment 1. In particular, it is shown an embodiment with series of baffles A and B which can be locked with equal and opposite rotations +φ, −φ.

Locking of the tubes can be seen in FIGS. 5 and 6: the rotation of a baffle through an angle φ brings a tube 4 towards the wedge-like zone 9 of the associated window 7 where locking takes place. The angle β of inclination of the surfaces 10 in this case may be defined with respect to the line 13 tangential to the circular arc travelled by the window 7 upon rotation (FIG. 7).

An embodiment of the type shown in FIG. 2 is called "shift-lock", while an embodiment of the type shown in FIG. 5 is called "twist-lock".

The windows 7 of a single baffle 5 may be all identical or may have different shape and/or orientation, depending on various embodiments of the invention.

In the twist-lock embodiments, the provision of windows 7 with a different shape depending on the distance from the axis of rotation may be preferred, in order to obtain uniform locking, thus compensating for the greater displacement of the peripheral windows with respect to those close to the axis. In order to compensate for this difference, preferably, the baffles 5 comprise two or more concentric rows of windows 7 with a varied shape.

Figure 8:
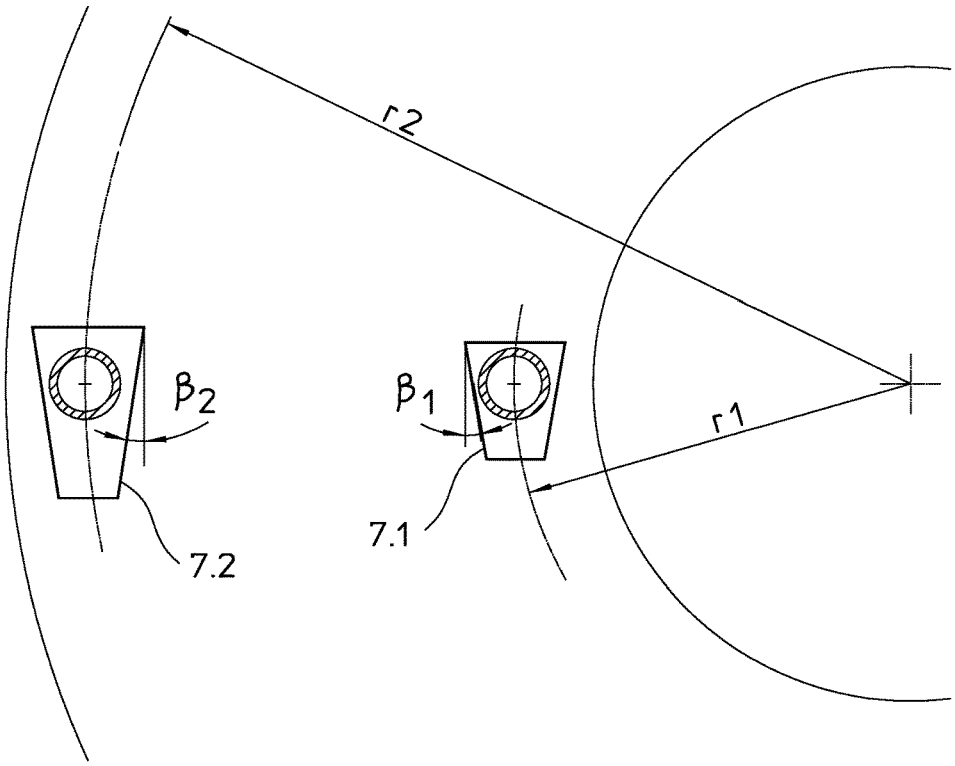
FIG. 8 shows a preferred embodiment for the windows of the baffles, in particular for the embodiments of the type shown in FIGS. 5-7.

For example, as shown in FIG. 8, a window 7.1 at a distance r1 from the axis of rotation preferably has effective surfaces 10 with a locking angle greater than a window 7.2 situated at a greater distance r2 from the axis. The greater locking angle compensates for the smaller arc travelled by the window 7.1 close to the axis, for the same rotation φ. In greater detail, FIG. 8 has β1>β2 where β1 is the locking angle of the window 7.1 close to the axis and β2 is the locking angle of the window 7.2 distant from the axis. In other words, the windows close to the axis have a sharper wedge-like locking zone 9 so as to obtain the desired locking despite the relatively small displacement.

The twist-lock configuration according to FIG. 5 is advantageously applicable to equipment with tubes arranged on concentric circumferences, rather than in a square or triangular pitch. Equipment with this arrangement of tubes is commonly used for example to realize heat exchangers inside reactors for the ammonia synthesis which have the tubes arranged on circular ranks.

FIGS. 2-4 and 5-7 show embodiments where the set of baffles 5 comprises a first series of baffles 5A and a second series of baffles 5B which can be locked with displacements or rotations of the same magnitude having opposite direction or sense. In both cases the baffles of the first series and the second series are alternated. Consequently the tubes 4 are supported alternately according to different planes. These embodiments are suitable for supporting tubes in a square or triangular arrangement, which fit most applications. Some embodiments may envisage a greater number of series of baffles having a different geometry, for example forming a sequence of baffles 5', 5", . . . $5^{(n)}$ repeated along the tube bundle.

Figure 9:
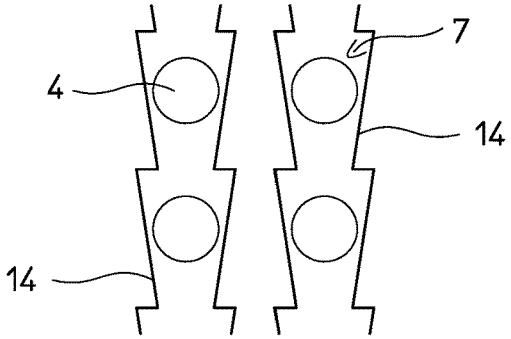
FIGS. 9 and 10 show other embodiments of the windows of the baffles intended to receive the tubes.
Figure 10:
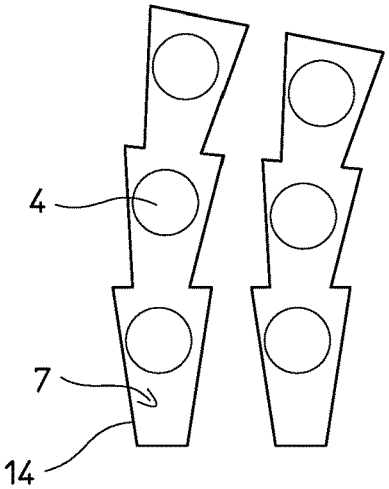

FIGS. 9 and 10 show variants in which the single windows 7, for example trapezoidal, are connected without a solution of continuity, for example being formed by means of saw cuts 14 made in the baffles 5. The variant of FIG. 9 applies to the shift-lock embodiments and the variant of FIG. 10 applies to the twist-lock embodiments. This variant may be preferred when the tubes are quite close to each other.

In the embodiments according to FIGS. 1-10 the tube receiving seats are represented by the above described windows 7, each intended to receive a single tube 4 of the bundle. Other embodiments are possible wherein each seat of the baffles 5 is configured to receive a plurality of tubes.

A preferred application of the invention relates to axial-flow heat exchangers, wherein the shell-side fluid passes through the baffles; in this case, in order to avoid an excessive obstruction of the section for the passage of fluid through the baffles (which would cause an excessive increase of the load losses) each seat advantageously receives a plurality of tubes.

Figure 11:
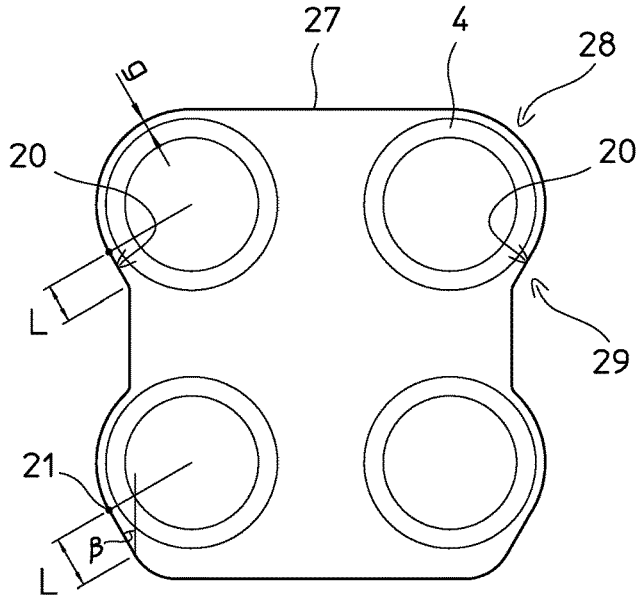
FIGS. 11 and 12 show an example with baffles having windows designed to receive a plurality of tubes, with free and locked tubes, respectively.

For example, FIG. 11 shows an embodiment of the invention in which the tube receiving seats are in the form of windows 27 designed to receive four tubes with shift-lock.

A window 27 has a substantially rectangular shape and comprises four corner lobes designed to receive respective tubes 4. A lobe comprises a surface in the form of a circle arc which defines a zone 28 for receiving the tube 4 with play, and an effective surface 20 inclined with respect to the locking direction and defining a locking zone 29. The point 21 (FIG. 12) indicates the point of contact with the tube resulting from the displacement of the window 27 into the working position.

FIG. 11 shows the assembly position in which the tubes 4 are located in the regions 28 of the lobes and consequently are received with a certain play. The figure also shows some characteristic parameters of the window 27, namely the length L of the effective surface 20 and the locking angle β.

Figure 12:
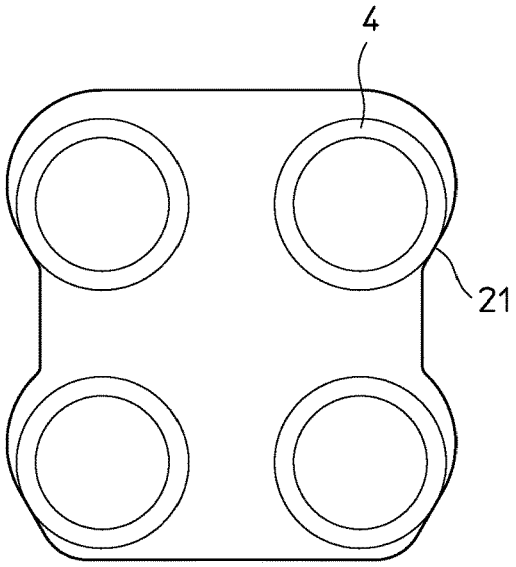

FIG. 12 shows the working condition in which each of the four tubes is locked making contact at point 21 with a respective effective surface 20.

Figure 13:
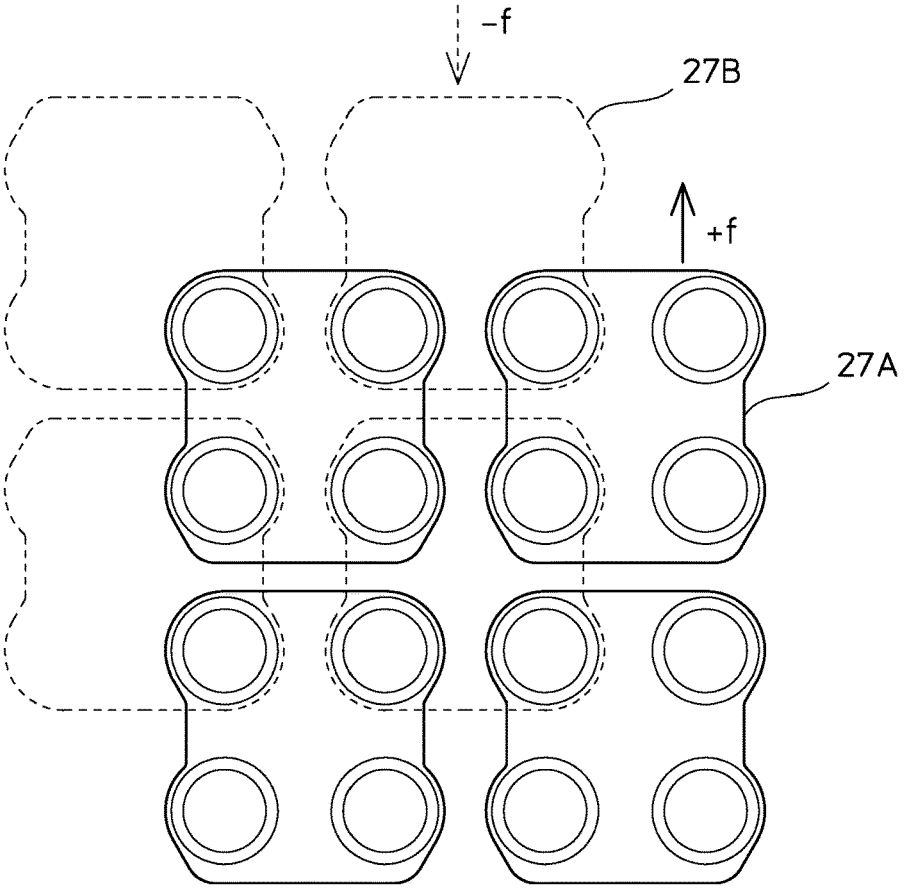
FIG. 13 shows a preferred arrangement of the windows in consecutive baffles of the type shown in FIG. 11.

FIG. 13 shows, respectively with continuous and broken lines, a preferred arrangement of windows 27A and 27B belonging to two adjacent baffles, which can be locked with opposite displacements during operation (for example two baffles 5A and 5B, as shown in FIG. 2). It is noted that the windows of adjacent baffles are staggered horizontally and vertically by an offset distance equal to the tube pitch so as to receive different groups of tubes 4.

Figure 14:
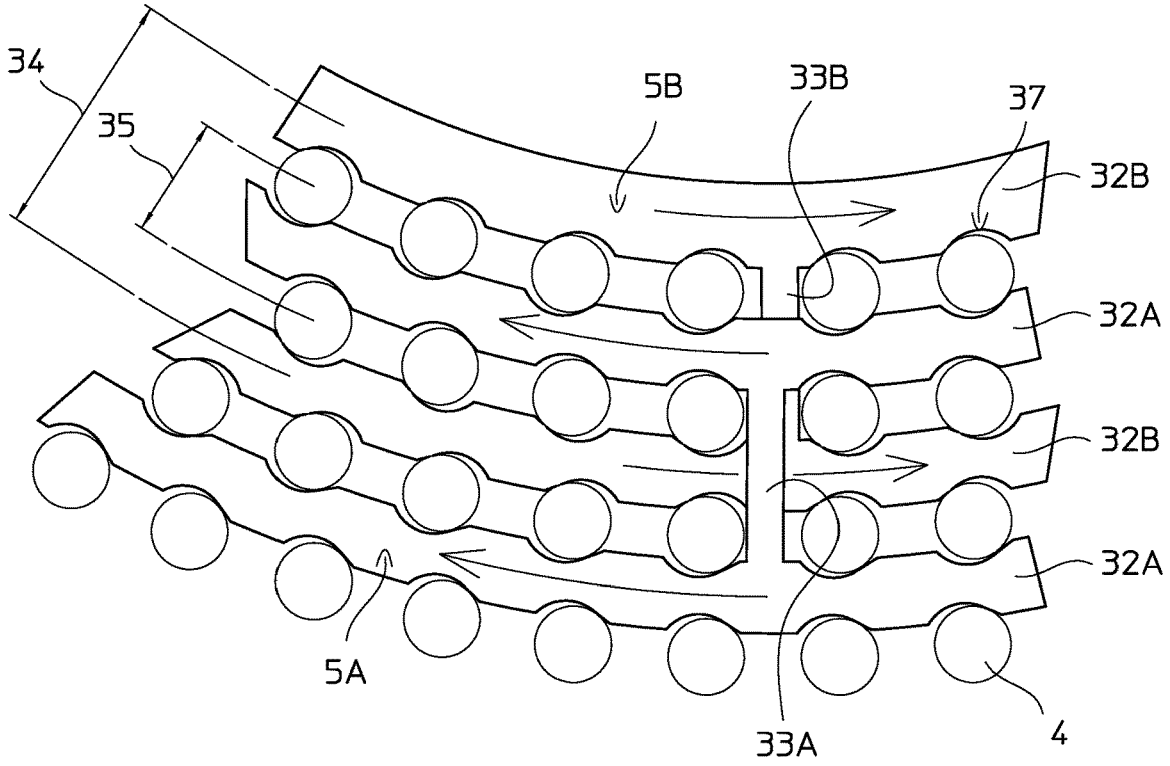
FIG. 14 shows another embodiment of the invention in which the baffles consist essentially of concentric rings.
Figure 15:
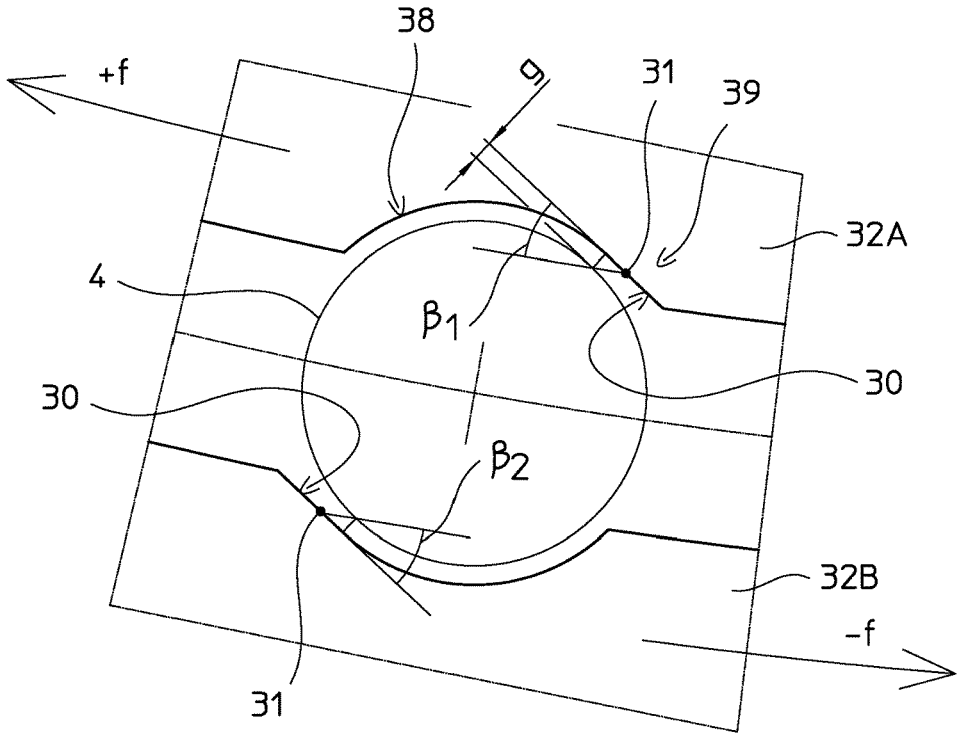
FIG. 15 shows a detail of FIG. 14 illustrating locking of a tube.

FIGS. 14 and 15 show another embodiment of the twist-lock type, namely with tubes arranged in concentric rows and baffles lockable by rotation. In this embodiment a baffle is formed essentially by concentric rings connected by bridge portions.

The tube receiving seats are formed on the edges of the concentric rings, in the form of substantially semicircular recesses 37 comprising a straight portion inclined relative to the locking direction, which defines the effective surface 30. The reference numbers 38 and 39 (similar to the reference numbers 8, 9 and 28, 29) indicate the receiving zones with play and the zones for locking the tubes in the recess 37; the reference numbers 31 (similar to the reference numbers 11 and 21) indicate the point of contact of the tube against the effective surfaces 30.

In the example reference is made to two series of baffles denoted by A and B (in a similar manner to FIGS. 2 and 5) and lockable by means of opposite rotations +φ, −φ. The Figure shows two rings 32A of a first baffle 5A and two rings 32B of a second baffle 5B with the respective bridge portions 33A and 33B.

It should be noted that each tube 4, in the working position, rests alternately on a ring of a baffle 5A belonging to the first series and on a ring of a baffle 5B belonging to the second series. This is due to the fact that two adjacent rings of a single baffle are separated by a distance 34 which is twice the radial distance 35 between two consecutive rows of tubes and the fact that adjacent baffles are staggered by a distance equal to said radial distance 35 as shown for example in FIG. 14.

The method for assembling the equipment 1 comprises essentially the following steps.

The baffles 5 are arranged in a provisional assembly configuration such as for example the configuration of FIG. 2 or FIG. 5. In said provisional configuration, the seats 7 are arranged so that the tubes 4 can be inserted through the baffles and received with play in the regions 8. During this step the baffles 5 are advantageously kept at the correct distance (pitch p of FIG. 1) via suitable provisional means.

The insertion of the tubes is greatly facilitated by the play existing between tubes and seats of the baffles, and also the last tubes of the bundle may be positioned without difficulty. After completing the tube bundle, the baffles 5 are displaced and moved into the working position, for example by means of the linear displacements +f, −f or the rotations +φ, −φ. As a result, the tubes 4 are locked in the regions 9 of the baffles.

An embodiment such as that of FIGS. 11-13 or such as that of FIGS. 14-15 is assembled in a similar manner.

In a particularly preferred embodiment, after reaching the working condition (locked tubes), the baffles 5 are blocked by the insertion of the bundle into the shell 2 and structural cooperation with said shell.

The invention claimed is:

1. A shell-and-tube equipment comprising a shell, a bundle of tubes, a plurality of baffles supporting the tubes, each baffle having a plurality of seats for receiving the tubes, each seat receiving at least one tube, wherein:

each of said seats comprises at least one first region designed to receive said at least one tube with a predefined first play, and at least one second region designed to receive said at least one tube with a second play smaller than the first play, or with no play, each baffle is configured so as to be displaceable, with respect to the tube bundle, between an assembly position, and a working position, each tube of the bundle being received in the at least one first region of a respective seat when the baffle is in said assembly position, and in the at least one second region of the respective seat when the baffle is in said working position.

2. The equipment according to claim 1, wherein each baffle is displaceable from said assembly position in said working position with a linear displacement.

3. The equipment according to claim 1, wherein each baffle is configured so as to be displaceable from said assembly position in said working position with an angular rotation.

4. The equipment according to claim 3, wherein each baffle is configured so as to be displaceable from said assembly position in said working position with an angular rotation performed about an axis of the tube bundle.

5. The equipment according to claim 3, wherein:

the tubes are arranged in concentric rows;

the baffles comprise a plurality of concentric rings and said tubes receiving seats are formed as recesses of said circular rings.

6. The equipment according to claim 1, wherein adjacent baffles have tubes receiving seats with a conjugate shape and/or arrangement so that said adjacent baffles pass from the working position to the assembly position with opposite movements.

7. The equipment according to claim 1, wherein each of said tubes receiving seats comprises at least one effective surface which:

is spaced from a respective tube when the baffle is in said assembly position, and is in contact with said tube when the baffle is in said working position.

8. The equipment according to claim 7, each of the receiving seats comprising two effective surfaces which converge to form a wedge to define said second region.

9. The equipment according to claim 8, the receiving seats having a trapezoidal shape.

10. The equipment according to claim 1, wherein the baffles consist of flat metal sheets and the tubes receiving seats are represented by windows formed in the baffles.

11. The equipment according to claim 1, wherein the baffles are locked in respective working positions, spaced by a predefined pitch, directly by the shell of the equipment.

12. The equipment according to claim 1, wherein the tubes are straight tubes or U-shaped tubes in which the baffles are mounted on respective straight portions.

13. The equipment according to claim 1, wherein the equipment is an axial-flow heat exchanger in which a shell-side fluid passes through the baffles and each seat receives a plurality of tubes.

* * * * *